US009113684B1

(12) United States Patent
Oppenheimer

(10) Patent No.: US 9,113,684 B1
(45) Date of Patent: Aug. 25, 2015

(54) UMBRELLA COVER SYSTEM

(71) Applicant: Helen Oppenheimer, Glendale, AZ (US)

(72) Inventor: Helen Oppenheimer, Glendale, AZ (US)

( * ) Notice: Subject to any disclaimer, the term of this patent is extended or adjusted under 35 U.S.C. 154(b) by 86 days.

(21) Appl. No.: 13/911,126

(22) Filed: Jun. 6, 2013

Related U.S. Application Data

(60) Provisional application No. 61/658,952, filed on Jun. 13, 2012.

(51) Int. Cl.
*A45B 3/02* (2006.01)
*A45B 25/18* (2006.01)
*F21L 4/02* (2006.01)

(52) U.S. Cl.
CPC .. *A45B 25/18* (2013.01); *F21L 4/02* (2013.01)

(58) Field of Classification Search
USPC ..... 362/102, 192; 135/33, 41, 16
See application file for complete search history.

(56) References Cited

U.S. PATENT DOCUMENTS

| | | | | |
|---|---|---|---|---|
| 2,746,469 | A * | 5/1956 | D Andrea | 135/33.41 |
| 4,061,154 | A * | 12/1977 | Cox et al. | 135/33.41 |
| 5,429,147 | A * | 7/1995 | Barrington | 135/33.5 |
| 6,837,255 | B2 * | 1/2005 | Bunch et al. | 135/16 |
| 7,581,504 | B1 | 9/2009 | Tsui et al. | |
| 7,604,015 | B2 * | 10/2009 | Fraser | 135/31 |
| 7,726,852 | B2 * | 6/2010 | Sanoner et al. | 362/398 |
| 8,104,491 | B2 * | 1/2012 | Li | 135/16 |
| 8,727,555 | B2 * | 5/2014 | Kuelbs | 362/102 |
| 2003/0178052 | A1 | 9/2003 | Chen | |
| 2005/0005958 | A1 * | 1/2005 | Connelly | 135/33.41 |
| 2006/0260668 | A1 | 11/2006 | Stollar | |
| 2007/0125409 | A1 | 6/2007 | Cullen | |

* cited by examiner

*Primary Examiner* — Ali Alavi
(74) *Attorney, Agent, or Firm* — Emery L. Tracy; Ruth Eure

(57) ABSTRACT

An umbrella cover system for covering an umbrella is provided. The umbrella has a center post. The umbrella cover system comprises a round cover having a first side, a second side, and an outer perimeter edge. An aperture is formed in the center of the cover with the aperture having a center point and the center point of the aperture being equidistant from every point of the perimeter edge. A fastening mechanism is positioned between the cover and the umbrella for releasably securing the cover to the umbrella. Upon positioning the first side of the cover against the umbrella with the center post of the umbrella extending through the aperture, the fastening means are activated to releasably secure the cover directly against the umbrella.

10 Claims, 1 Drawing Sheet

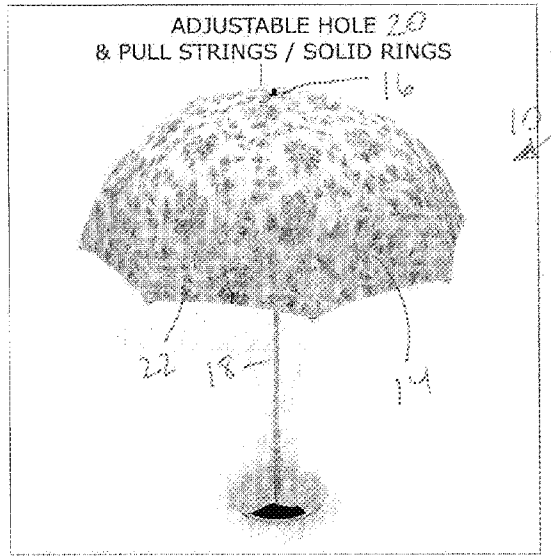
FIG. 3
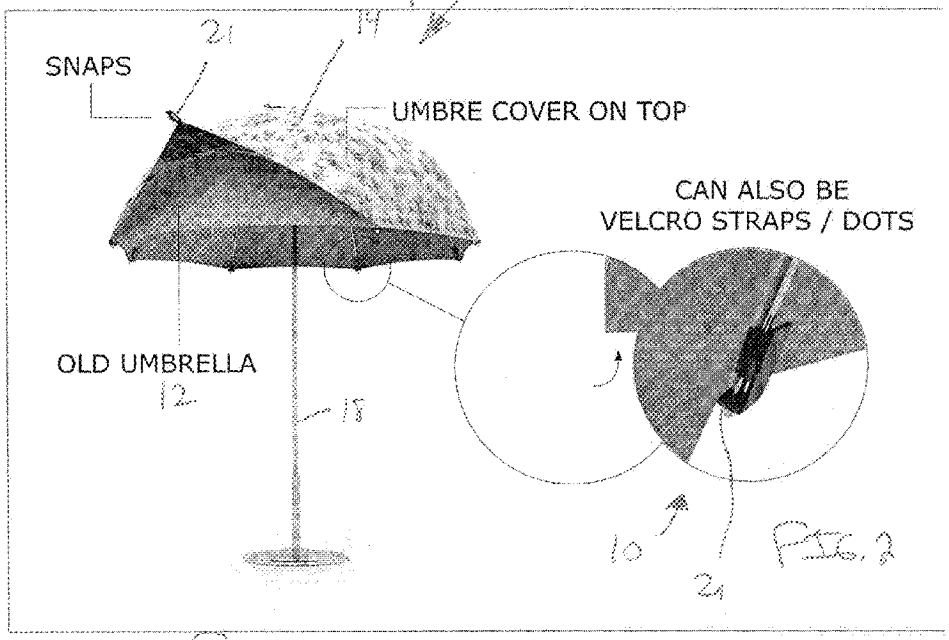
FIG. 1
FIG. 2
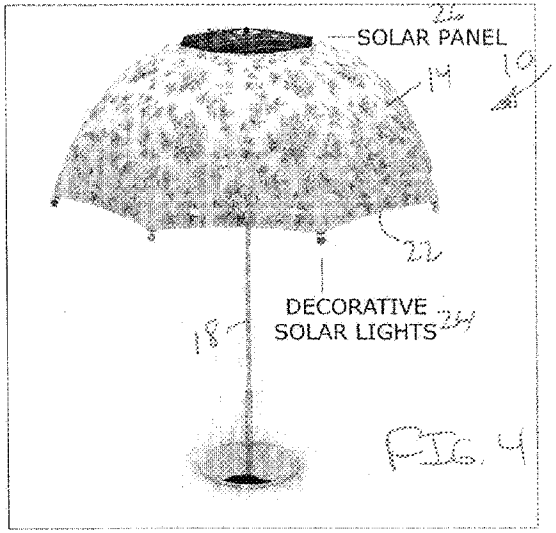
FIG. 4

UMBRELLA COVER SYSTEM

The present application claims the benefit of priority of provisional patent application Ser. No. 61/658,952, filed on Jun. 13, 2012, entitled "Umbrella Cover".

BACKGROUND OF THE INVENTION

1. Field of the Invention

This invention relates generally to an umbrella cover system and, more particularly, the invention relates to an umbrella cover system providing a decorative cover easily applied over an existing tabletop or outdoor umbrella thus protecting and/or improving the appearance of the umbrella.

2. Description of the Prior Art

While there is little dispute that tabletop umbrellas are a practical accessory item, over time, constant exposure to the elements can cause these umbrellas to fade, resulting in a less than pristine appearance. As can be imagined, a once bright red tabletop umbrella which has faded to splotchy pink can detract from festive party decor when throwing a backyard barbecue. While the umbrella itself may still be fully functional and in great shape, the very appearance of a weathered umbrella can result in one discarding the umbrella entirely in order to replace it with a new unit. A costly waste, throwing out a perfectly good umbrella, simply because it is faded is not an option for many conscientious consumers, particularly during these trying economic times. Considering that umbrellas can be expensive, most consumers try to get the most out of their money, using an umbrella long after it has lost its like-new appearance.

SUMMARY

The present invention is an umbrella cover system for covering an umbrella. The umbrella has a center post. The umbrella cover system comprises a round cover having a first side, a second side, and an outer perimeter edge. An aperture is formed in the center of the cover with the aperture having a center point and the center point of the aperture being equidistant from every point of the perimeter edge. A fastening mechanism is positioned between the cover and the umbrella for releasably securing the cover to the umbrella. Upon positioning the first side of the cover against the umbrella with the center post of the umbrella extending through the aperture, the fastening means are activated to releasably secure the cover directly against the umbrella.

In addition, the present invention includes a method for covering an umbrella, the umbrella having a center post. The method comprises providing a round cover having a first side, a second side, and an outer perimeter edge, forming an aperture in the center of the cover with the aperture having a center point and the center point of the aperture being equidistant from every point of the perimeter edge, positioning the first side of the cover against the umbrella with the center post of the umbrella extending through the aperture, and releasably securing the cover directly against the umbrella.

The present invention further includes an umbrella cover system for covering an umbrella. The umbrella has a center post. The umbrella cover system comprises a round cover having a first side, a second side, and an outer perimeter edge. An aperture is formed in the center of the cover with the aperture having a center point and the center point of the aperture being equidistant from every point of the perimeter edge. A plurality of evenly spaced fastening mechanisms are positioned along the perimeter of the cover between the cover and the umbrella for releasably securing the cover to the umbrella. A least one solar light is positioned on the cover and a solar panel is positioned on the second side of the cover and electrically connected to the solar light. Upon positioning the first side of the cover against the umbrella with the center post of the umbrella extending through the aperture, the fastening means are activated to releasably secure the cover directly against the umbrella.

BRIEF DESCRIPTION OF THE DRAWINGS

FIG. 1 is a perspective view illustrating an umbrella cover system, constructed in accordance with the present invention, with the umbrella cover system having snap attachment mechanisms for securing to an umbrella;

FIG. 2 is an exploded perspective view illustrating the umbrella cover system, constructed in accordance with the present invention, with the umbrella cover system having hook and loop fastener attachment mechanisms for securing to the umbrella;

FIG. 3 is a perspective view illustrating the umbrella cover system, constructed in accordance with the present invention, with draw strings for further securing the umbrella cover system to the umbrella; and FIG. 4 is a perspective view illustrating the umbrella cover system, constructed in accordance with the present invention, with decorative solar lights powered by a solar panel.

DETAILED DESCRIPTION OF THE PREFERRED EMBODIMENTS

As illustrated in FIGS. 1-4, the present invention is an umbrella cover system, constructed in accordance with the present invention, providing a decorative cover easily applied over an existing tabletop or outdoor umbrella 12 thus protecting and/or improving the appearance of the umbrella. The umbrella cover system 10 of the present invention includes a circular shaped cover 14 preferably constructed of weather resistant canvas, nylon or comparable fabric material.

The cover 14 of the umbrella cover system 10 of the present invention can be offered in a variety of sizes to accommodate various size table top and outdoor umbrellas available on the market. Preferably a one piece unit, the circular cover 14 can be double stitched and reinforced to ensure the structural integrity of the cover 14. Located in the center of the cover 14 is a circular shaped opening 16 accommodating the top of an umbrella post 18 of the umbrella 12. The opening 16 can include either a solid ring support or an adjustable pull string fastener 20 for use in securing the cover 14 to the top of the umbrella pole 18.

In addition, the cover 14 of the umbrella cover system 10 of the present invention includes a plurality of fastening mechanisms 21 spaced along an outer perimeter 22 of the cover 14 for use in anchoring the cover 14 to the existing umbrella 12. Preferably, the fastening mechanisms 21 are evenly spaced around the entire perimeter 22 of the cover 14 although any type of spacing of the fastening mechanisms 21 is within the scope of the present invention. The fastening mechanisms 21 can include Velcro straps, self-affixing Velcro tabs, snaps, and sturdy clips, to name a few options, with the fastening mechanisms 21 secured beneath the existing umbrella canopy 12, thus hiding the fastening mechanisms 21 from view.

Most notably, the cover 14 of the umbrella cover system 10 is offered in a host of vibrant colors, patterns and printed designs. Patterns include brightly colored floral prints, tropical and aquatic prints, geometric patterns and stripes, to name a few options. Covers 14 can also be made available that celebrate specific themes or events. For instance, covers 14 adorned with sporting equipment, prints that celebrate birthdays, anniversaries and a myriad of holiday designs including covers for use during Independence Day celebrations, Thanksgiving, Christmas and Easter, can all be offered in the cover line. The covers 14 can also be imprinted with the names and logos of professional and amateur sports teams, beer manufactures and other corporate logos. Versions of the cover 14 can also be offered in versions adorned with solar lights 24 powered by a solar panel 26 thus serving to illuminate the umbrella 12 after dark. As can be imagined, design possibilities for the cover 14 are virtually limitless. Although the primary purpose of the cover 14 is to accommodate tabletop and outdoor umbrellas 12, the cover 14 can also be constructed to include covers 14 for use with handheld rain umbrellas.

The manner of use of the umbrella cover system 10 of the present invention will now be described. It will be understood by those skilled in the art that the manner of use of the umbrella cover system 10 described herein is merely one method of use and other methods of use of the umbrella cover system 10 are within the scope of the present invention.

Use of the umbrella cover system 10 of the present invention is very simple and straightforward. First, the user purchases one or more covers 14 in the appropriate size and desired color. For instance, a brightly colored blue cover 14 adorned with the image of tropical fish look striking on a poolside outdoor table. Alternately, one may purchase a cover 14 adorned with the image of colorful balloons, streamers and confetti and emblazoned with the repeated message of "Happy Birthday!" for use during a child's birthday party. Once purchased, the user closes the existing tabletop umbrella 12, sliding the cover 14 over the top of the closed canopy and positioning the cover 14 so that the small circular opening 16 located in the center of the cover 14 is positioned over and around the existing umbrella post 18. In the case of the cover 14 featuring a solid ring support, the user simply sets the ring atop the juncture of the post 18 and the umbrella's expandable side arms. Alternately, in the case of the cover 14 featuring a pull string fastener 20, the user tightens and tie the fastener around the umbrella post 18, thus securing the top of the cover 14 to the post 18. With the top of the cover 14 secured, the fabric of the cover 14 drapes over the existing umbrella 12, with the user opening the umbrella canopy partially in order to further secure the cover 14 in place. With the umbrella canopy partially opened, the user secures the Velcro straps, self-affixing tabs, snaps, or clip fasteners located on the bottom of the cover 14 about the perimeter of the base of the umbrella canopy. With the cover 14 properly applied, the user simply opens their umbrella 12, enjoying the festive new look provided. The cover 14 is then left in place as long as desired, as well as periodically replaced and/or updated with a new cover of a different design.

The umbrella cover system 10 of the present invention offers users a number of significant benefits and advantages. Foremost, the umbrella cover system 10 provides those who own tabletop or outdoor umbrellas 12 a simple way in which to dramatically improve and alter the appearance of their umbrella 12. An easily applied decorative cover 14, the cover 14 of the umbrella cover system 10 discreetly hides a faded and frayed umbrella 12 from view, via a vibrantly colored cover 14. Offered in a myriad of charming patterns and designs for everyday or party use, the cover 14 provides an affordable means of enhancing the appearance of these outdoor accessories. An affordable alternative to entirely replacing an umbrella canopy, simply because it is faded or outdated, the umbrella cover system 10 effectively saves users money, while also providing a plethora of design options. Users will enjoy picking one or more covers 14 from the umbrella cover system line in order to complement their backyard decor, a particular party theme or holiday celebration. Whether a diehard baseball aficionado who prefers a cover 14 adorned with baseballs and bats; a homemaker who chooses a festive ladybug print for a child's birthday party; or a backyard barbecue chef who chooses a brightly colored cover 14 adorned with the repeated image of the American flag to compliment a 4th of July celebration, the cover 14 offers users virtually endless design possibilities. Ideal for general household use, the umbrella cover system 10 can also be utilized at restaurants, beach resorts and similar public establishments where tabletop umbrellas 12 are employed. Further, as the umbrella cover system 10 can be expanded to include covers 14 for handheld rain umbrellas, users can purchase covers 14 to complement their wardrobe or a particular mood. Simple to use, users will appreciate the ease of which the cover 14 of the umbrella cover system 10 can be applied and changed.

The umbrella cover system 10 of the present invention provides users a practical means of dramatically improving or altering the appearance of their outdoor umbrella 14. Simple to use, the umbrella cover system 10 proves a favorite of anyone who enjoys spending time outdoors.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention to be limited only to the claims except as precluded by the prior art. Moreover, the invention as disclosed herein may be suitably practiced in the absence of the specific elements which are disclosed herein.

What is claimed is:

1. A decorative umbrella cover system for covering an umbrella, the umbrella having a center post, the umbrella cover system comprising:

a circular cover having a first side, a second side, and an outer perimeter edge and not having a radial opening;

an aperture formed in the center of the cover, the aperture having a center point, the center point of the aperture being equidistant from every point of the perimeter edge; and fastening means between the cover and the umbrella for releasably securing the cover to the umbrella;

wherein upon positioning the first side of the cover against the umbrella with the center post of the umbrella extending through the aperture, the fastening means are activated to releasably secure the cover directly against the umbrella.

2. The decorative umbrella cover system of claim 1 wherein the umbrella is selected from the group consisting of a tabletop umbrella, and an outdoor umbrella.

3. The decorative umbrella cover system of claim 1 wherein the cover is constructed of weather resistant canvas, nylon fabric material.

4. The decorative umbrella cover system of claim 1 the cover is constructed from a single piece of material.

5. The decorative umbrella cover system of claim 1 wherein the aperture is surrounded by a solid ring.

6. The decorative umbrella cover system of claim 1 wherein the aperture is surrounded by a sleeve, and further comprising:

a pull string fastener positioned within and exiting the sleeve for releasably securing the cover to the post of the umbrella.

7. The decorative umbrella cover system of claim 1 wherein the fastening means is a plurality of fastening mechanisms spaced along an outer perimeter of the cover.

8. The decorative umbrella, cover system of claim 7 wherein the fastening mechanisms are evenly spaced around the entire perimeter of the cover.

9. The decorative umbrella cover system of claim 7 wherein the fastening mechanism are hook and loop fasteners.

10. The decorative umbrella cover system of claim 7 wherein the fastening mechanisms are snaps.

* * * * *